US006195515B1

(12) United States Patent
Fujita et al.

(10) Patent No.: US 6,195,515 B1
(45) Date of Patent: Feb. 27, 2001

(54) DEVELOPING APPARATUS INCLUDING A SEAL MEMBER SANDWICHED BETWEEN A DEVELOPER BEARING MEMBER AND A LEAKAGE PREVENTING MEMBER

(75) Inventors: Akiyoshi Fujita; Kenji Matsuda, both of Numazu; Tadashi Horikawa, Susono, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/375,998

(22) Filed: Aug. 19, 1999

(30) Foreign Application Priority Data

Aug. 31, 1998 (JP) ..... 10-259210

(51) Int. Cl.[7] ..... G03G 15/08
(52) U.S. Cl. ..... 399/103; 399/105
(58) Field of Search ..... 399/102, 103, 399/105, 106, 111

(56) References Cited

U.S. PATENT DOCUMENTS 5,585,895 * 12/1996 Yashiro et al. ..... 399/103
5,740,500 * 4/1998 Hashimoto ..... 399/114
5,758,230 * 5/1998 Nakaue et al. ..... 399/103

FOREIGN PATENT DOCUMENTS 36-10231 7/1951 (JP) .
54-43038 4/1979 (JP) .
59-53856 3/1984 (JP) .
8-146761 * 6/1996 (JP) .
10-20665 * 1/1998 (JP) .

* cited by examiner

*Primary Examiner*—Joan Pendegrass
(74) *Attorney, Agent, or Firm*—Fitzpatrick, Cella, Harper & Scinto

(57) ABSTRACT

A developing apparatus includes a seal member, which is sandwiched between a developer bearing body and a leakage preventing member in an end portion, and in a lengthwise direction, a length of a free end of the seal member is greater than a length by which the seal member is supported. A contacting width between the seal member and the leakage preventing member in the lengthwise direction is smaller toward the free end.

18 Claims, 8 Drawing Sheets

DEVELOPING APPARATUS INCLUDING A SEAL MEMBER SANDWICHED BETWEEN A DEVELOPER BEARING MEMBER AND A LEAKAGE PREVENTING MEMBER

BACKGROUND OF THE INVENTION

1. Field of the Invention

This invention relates to a developing apparatus which can be used in an image forming apparatus such as an electrophotographic copying apparatus or an electrophotographic printer.

2. Related Background Art

Heretofore, an image forming apparatus using, for example, an electrophotographic system has been provided with, for example, a rotatable drum-like electrophotographic photosensitive body, i.e., a photosensitive drum, as an image bearing body, in substantially the central portion thereof, and charging means uniformly charges the surface thereof. Thereafter, the surface of the photosensitive body is subjected to exposure and an electrostatic latent image corresponding to an image signal is formed on that surface. This electrostatic latent image comes to a position opposed to a developing apparatus with the rotation of the photosensitive body, and is visualized by a developer, and a so-called toner image is formed on the photosensitive body. Thereafter, this toner image is electrostatically transferred onto a recording material by transferring means and further, is fixed by heat and pressure in a fixing device, whereby a permanent image is formed on the recording material. A cleaning device for removing any toner or the like remaining on the photosensitive body after the termination of the transfer is disposed at a desired location.

As the developing apparatus in the image forming apparatus adopting the construction as schematically described above, various ones using a dry type monocomponenet developer as the developer have been proposed and put into practical use. Particularly, there is known a developing apparatus using only non-magnetic toner particles (hereinafter simply referred to as the "toner") as the dry type monocomponent developer.

Such a developing apparatus is provided with a rotatable sleeve-like developer bearing body, i.e., a developing sleeve, in order to carry the toner to a developing position opposed to the photosensitive drum, make the toner adhere to the electrostatic latent image on the photosensitive drum and form a toner image thereon. In any developing apparatuses, however, it is not easy to form a thin layer of the monocomponenet developer, i.e., the toner, on the developing sleeve, and it is a main point in the image forming operation.

Nowadays, improvements in the resolution, clearness, etc. of an image formed by the image forming apparatus have been further required, and in the developing apparatus as described above, there have been made various proposals regarding a method of forming a thin layer of toner on the developing sleeve and a developing apparatus embodying it.

For example, in a developing apparatus disclosed in Japanese Patent Application Laid-Open No. 54-43038, an elastic blade as developer layer thickness regulating means made of rubber or a metal is made to be abutted against the surface of the developing sleeve. That is, the toner is made to pass through the abutting portion of contact between this elastic blade and the developing sleeve and the layer thickness of the toner is regulated to thereby form a thin layer of the toner on the developing sleeve and, in this abutting portion, triboelectricity (frictional charging amount) sufficient for development is imparted to the toner.

In the prior art as described above, to regulate nonmagnetic toner particles by the elastic blade, means for supplying the toner onto the developing sleeve becomes separately necessary. That is, as is heretofore known, in the case of a developing apparatus using magnetic toner particles as a monocomponent developer, it is possible to supply the toner onto a developing sleeve by a magnetic force produced by a magnet provided in the developing sleeve, whereas this is impossible in the case of a developing apparatus using nonmagnetic toner particles.

So, in order to effect the supply of the toner to the developing sleeve, it has been variously proposed to make a roller-like member having elasticity using a foamed rubber material such as polyurethane foam or sponge or a brush material abut against the developing sleeve. FIG. 9 of the accompanying drawings shows an example of the prior art developing apparatus using a monocomponent developer.

The developing apparatus 4 contains non-magnetic toner particles (toner) in a developing container 41, and a portion of that side of the developing container 41 on which the developing apparatus 4 and a photosensitive drum 1 are opposed to each other opens, and in such a manner as to expose a circumferential portion from this opening portion, a developing sleeve 42 as a developer bearing body is supported on the developing container 41 for rotation in the direction of arrow B. Also, spacers (not shown) as gap regulating members are provided on the lengthwisely opposite end portions of the developing sleeve 42, and these spacers abut against the surface of the photosensitive drum 1, whereby the surface of the photosensitive drum 1 and the surface of the developing sleeve 42 are opposed to each other with a predetermined distance therebetween.

An elastic blade 44 as developer layer thickness regulating means for regulating the quantity of toner abutted on the surface of the developing sleeve 42 bears against the developing sleeve 42, and at a position upstream of this elastic blade 44 with respect to the direction of rotation of the developing sleeve 42, an elastic roller 43 as developer supplying and scraping means abuts against the developing sleeve 42.

When the developing apparatus 4 starts its developing operation, the toner is agitated by the rotation of an agitating member 45 in the direction of arrow C and is carried to the elastic roller 43 side. The toner is borne on the surface of the developing sleeve 42 while being preliminarily charged by the friction thereof with the elastic roller 43 rotated in the direction of arrow D, whereafter the toner is carried to the abutting portion between the elastic blade 44 and the developing sleeve 42 with the rotation of the developing sleeve 42, and has its layer thickness regulated and becomes a thin layer. By the friction at this time, desired charging is imparted to the toner.

Thereafter, the toner borne and carried to a developing position opposed to the photosensitive drum 1 with the rotation of the developing sleeve 42 flies onto the photosensitive drum 1 by a developing bias voltage applied to the developing sleeve 42, and selectively adheres to the electrostatic latent image on the surface of the photosensitive drum to thereby form a toner image. Any toner remaining on the surface of the developing sleeve 42 without contributing to development is again carried into the developing container 41 by the rotation of the developing sleeve 42, and is scraped off by the elastic roller 43, whereby it is mixed with the toner in the developing container 41.

When in such a prior art developing apparatus, a metal material is used as the developing sleeve 42, if a blade made of a metallic thin plate is used as the elastic blade 44, it will abrade the developing sleeve 42, and this is not preferable. To obtain a good thin layer of toner, it is necessary to use a rubber material such as urethane or silicone rubber.

By adopting the construction schematically described above, it has become possible to well effect the formation of a thin layer of toner on the developing sleeve 42.

However, a developing apparatus using nonmagnetic toner particles (toner), unlike a developing apparatus using magnetic toner particles, cannot utilize a magnetic adsorbing force and therefore, cannot powerfully hold the toner on the developing sleeve 42. Accordingly, it is difficult to prevent the leakage of the toner to the outside of the developing apparatus 4.

That is, the other toner than the toner which has slipped out of the portion of pressure contact between the elastic blade 44 and the developing sleeve 42 and has been sufficiently charged has no adsorbing force enough for the developing sleeve 42 to the able to hold and therefore, the toner leaks out from the lower portion and the vicinity of the lengthwisely opposite end portions of the developing sleeve 42, and so-called toner leakage becomes liable to occur, and this is liable to cause the problem of contaminating the interior of the image forming apparatus by the toner.

Therefore, a flexible developer sealing member 46 abutting against the developing sleeve 42 with light pressure is provided on a lower frame 48 located in the opening portion of the bottom of the developing container 41 to thereby permit the passage of the toner carried again into the developing container 41 without contributing to development, and also prevent the toner in the developing container 41 from leaking out from the lower portion of the developing container 41.

The developing apparatus as described above is used in an image forming apparatus such as a compact copying apparatus or a page printer, but an apparatus in which a developing apparatus is made into a unit or process means including at least the developing apparatus and an image bearing body are integrally made into a cartridge which is detachably attachable to the main body of an image forming apparatus and can be interchanged has heretofore been put into practical use.

According to this process cartridge system, the maintenance of the apparatus can be done by a user himself without resorting to a serviceman and therefore, the operability of the apparatus can be markedly improved. However, the developing apparatus made into a unit or a process cartridge may suffer from the possibility of the toner leaking out by a light shock or the like applied thereto during the interchange thereof and therefore, various kinds of sealing are provided in the developing apparatus. Particularly, the above-described developer sealing member 46 effectively serves to prevent the leakage of the developer.

FIG. 10 of the accompanying drawings shows the developing position of the prior art developing apparatus 4 as it is seen from the photosensitive drum 1 side. For the convenience of illustrating the sealing of the toner, the developing sleeve 42 is not shown. Also, there is shown a developing area G which is a toner image forming area on the photosensitive drum 1.

As will be understood from FIGS. 9 and 10, a developer sealing member 46 which is in the form of a strip type sheet wider than the developing area G of the developing sleeve 42 is provided in the lower position of the opening portion of the developing container 41, and the lower frame 48 of the developing container lengthwisely fixes one end of the developer sealing member 46 which is adjacent to the photosensitive drum 1. Also, the free end of the developer sealing member 46 contacts with and frictionally slides on the developing sleeve 42 by its own elasticity in such a manner as to be along the direction of rotation of the developing sleeve 42.

As the material of the developer sealing member 46, use is made of thin urethane rubber, film-like polycarbonate of weak rigidity, PET or the like. During the collection of the toner which has not contributed to development, the developer sealing member 46 falls down inwardly of the developing apparatus as indicated by arrow E in FIG. 9 and does not hinder the collection of the toner. Against the blowing-out of the toner from the interior of the developing apparatus 4, the developer sealing member 46 comes into close contact with the developing sleeve 42 to thereby prevent the leakage of the toner.

Further, in the prior art developing container 41, in order to prevent the leakage of the toner from the lengthwisely opposite end portions of the developing sleeve 42, end portion peripheral surface sealing members 47 are provided in the inner portions opposite to the opening portion of the developing container 41 on the lengthwisely opposite end portions of the developing sleeve 42 which are outer than the developing area G, to thereby prevent the outflow of the toner to the outside of the developing area G.

Heretofore, as described above, as the end portion peripheral surface sealing members 47, use has been slidely made of ones having the surfaces thereof formed of felt or electrostatically implanted hair or the like and having the base material thereof formed by an elastic member, and as shown in FIGS. 9 and 10, the end portion peripheral surface sealing members 47 are urged against the outer peripheral surface of the developing sleeve 42 to thereby prevent the outflow of the toner.

In the prior art developing apparatus 4, however, on the lengthwisely opposite end portions of the developing sleeve 42, the developing sleeve 42 is designed to frictionally slide in close contact with the developer sealing member 46 in such a manner as to sandwich the latter between the end portion peripheral surface sealing member 47 and the developing sleeve 42. Therefore, a pull force in the direction of rotation of the developing sleeve 42 is applied to the developer sealing member 46, and by this force, the developer sealing member 46 is waved and accordingly, if the developing operation is repeated a number of times, there will arise the problem that the leakage of the toner occurs.

So, as a solution for this problem, from the viewpoint of decreasing the pull force applied to the developer sealing member 46, it is conceivable to reduce the area overlapping the developer sealing member 46 on the end portion peripheral surface sealing members 47 to prevent the waving of the developer sealing member 46.

However, if the overlapping area between the developer sealing member 46 and the end portion peripheral surface sealing members 47 is inadvertently decreased, a reduction in sealing performance will result in the lengthwisely opposite end portions of the lower frame 48 of the opening portion of the developing container 41 and after all, the leakage of the toner will occur from these portions.

As described above, the setting of the overlapping area between the developer sealing member 46 and the end portion peripheral surface sealing members 47 is delicately and sensitively concerned with the leakage of the toner.

SUMMARY OF THE INVENTION

It is an object of the present invention to provide a developing apparatus in which the sealing property of a developer sealing member is improved.

It is another object of the present invention to provide a developing apparatus of simple construction in which the waving of a developer sealing member attributable to a pull force (strength) by a developer bearing body is prevented and a reduction in the sealing performance of seal members on the lengthwisely opposite end portions of the opening portion of a developing container is prevented.

It is still another object of the present invention to provide a developing apparatus in which a seal member is made into a shape suitable for preventing the leakage of a developer from the developing apparatus.

DESCRIPTION OF THE PREFERRED EMBODIMENTS

The developing apparatus according to the present invention will hereinafter be described in greater detail with reference to the drawings.

Embodiment 1

Figure 1:
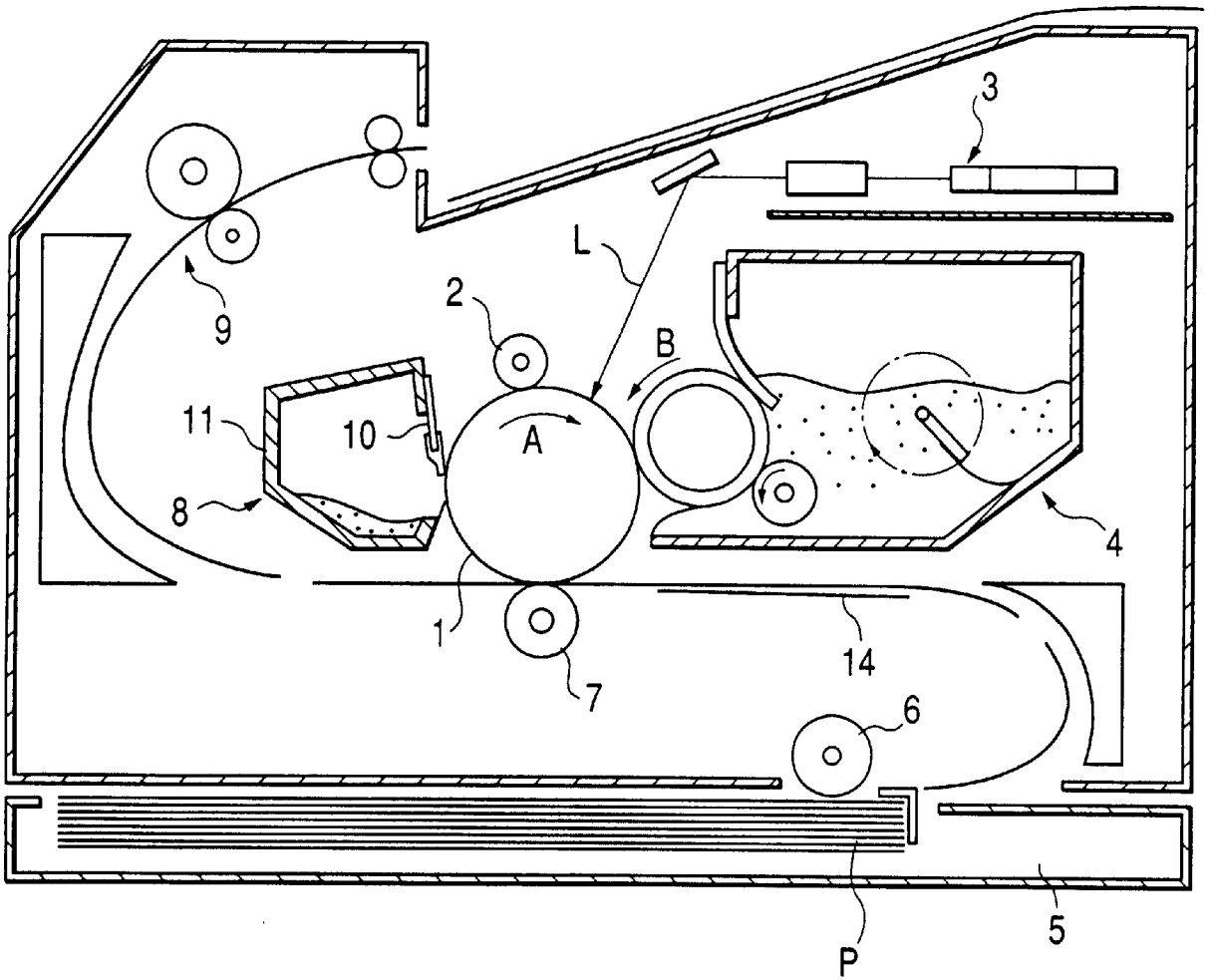
FIG. 1 is a schematic cross-sectional view showing an embodiment of a developing apparatus according to the present invention and an image forming apparatus provided with the same.

FIG. 1 schematically shows the construction of an embodiment of an image forming apparatus provided with the developing apparatus according to the present invention. According to the present embodiment, the present invention is embodied into a laser beam printer, but it should be understood that the present invention is not restricted thereto.

According to the present embodiment, the image forming apparatus supports a drum-like electrophotographic photosensitive body, i.e., a photosensitive drum 1, as an image bearing body for rotation in the direction of arrow A. The surface of the photosensitive drum 1 is uniformly charged by a charging roller 2 as charging means. Thereafter, the surface of the photosensitive drum 1 is exposed to a line scanning laser beam L from an optical system 3 corresponding to image information, whereby an electrostatic latent image corresponding to an image signal is formed on the surface of the photosensitive drum 1.

This electrostatic latent image comes to a position opposed to a developing apparatus 4 with the rotation of the photosensitive drum 1, and is visualized by a developer, and a so-called toner image is formed on the photosensitive drum 1. The toner image is then carried to a position at which a transfer roller 7 as transferring means and the photosensitive drum 1 abut against each other.

On the other hand, a recording material P contained in a cassette 5 is fed into the image forming apparatus by a sheet feeding roller 6 so as to be synchronized with the entry of the toner image on the photosensitive drum 1 into a transfer position, and is conveyed to the transfer position by conveying means 14.

The toner image on the photosensitive drum 1 which has thus come to the transfer position is electrostatically transferred onto the recording material P which has arrived at the transfer position, by a transfer roller 7. Thereafter, the recording material P bearing the unfixed toner image thereon is conveyed to a fixing device 9, where the unfixed toner image is fixed on the recording material P by heat and pressure.

The recording material P on which a permanent image has been thus formed is discharged out of the image forming apparatus. Also, any toner remaining on the photosensitive drum 1 after the completion of the transfer is scraped off by a cleaning blade 10, is contained into the waste toner container 11 of a cleaning device 8 and is repetitively used for the image forming operation.

According to the present embodiment, the developing apparatus 4 is made into a unit and is detachably attachable to the main body of the image forming apparatus. Also, the image forming apparatus of the present embodiment effects the so-called reversal developing of visualizing by the toner that portion of the surface of the photosensitive drum 1 uniformly charged by the charging roller 2 in which the charging charges (negative polarity) have been attenuated by exposure.

Figure 2:
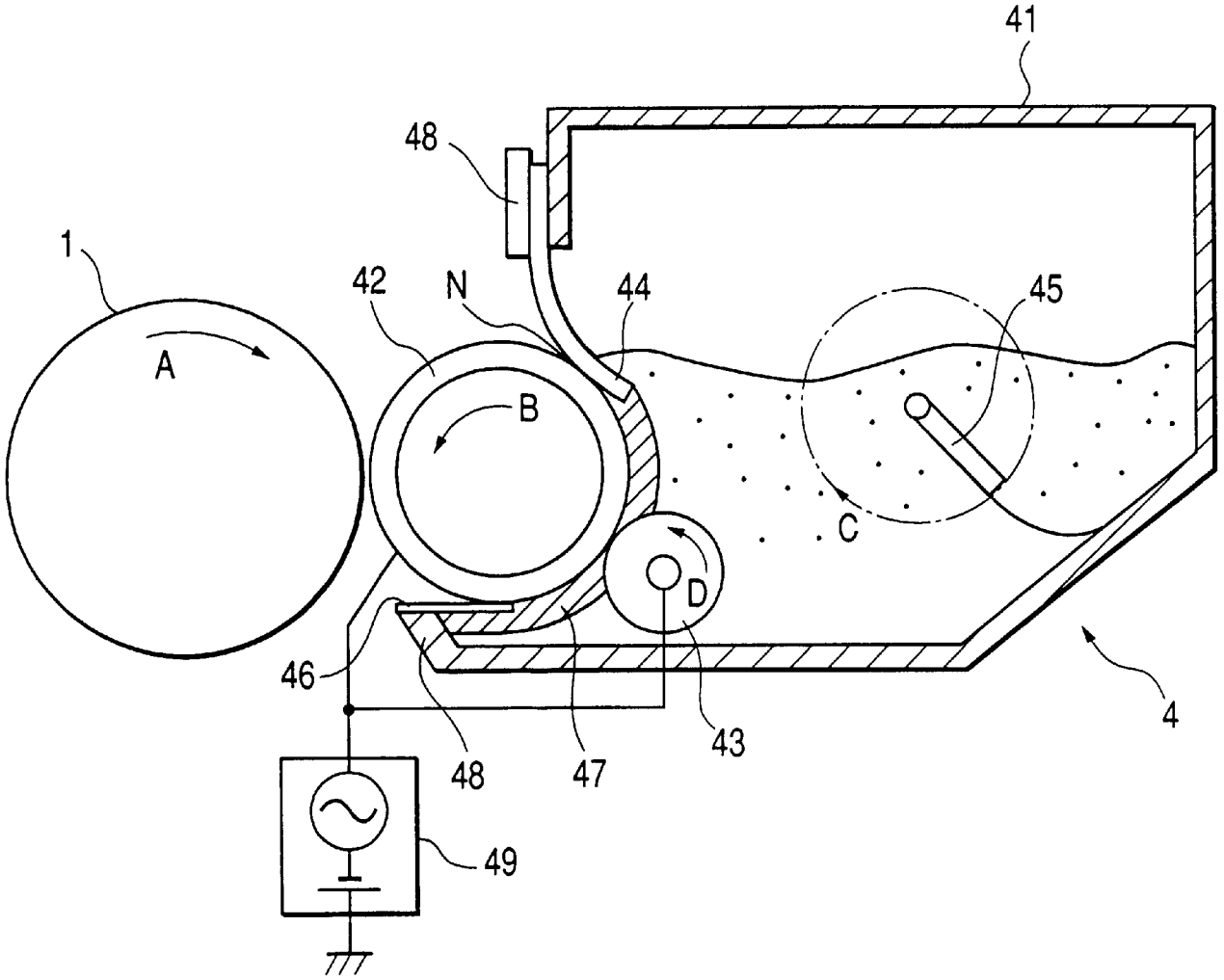
FIG. 2 is a schematic cross-sectional view showing an embodiment of the developing apparatus according to the present invention.

The developing apparatus of the present embodiment will now be described in greater detail. FIG. 2 schematically shows the construction of an embodiment of the developing apparatus according to the present invention.

The developing apparatus 4 contains only a nonmagnetic monocomponent developer, i.e., nonmagnetic toner particles (toner), as a developer in a developing container 41. The developing container 41 opens at a position extending in the lengthwise direction thereof and opposed to the photosensitive drum 1. In this opening portion, a developing sleeve 42 as a developer bearing body rotatively driven in the direction of arrow B is provided so that one half of the peripheral surface thereof may be exposed outside the developing container 41 and the opposite half of the peripheral surface may protrude into the developing container 41. Also, the surface of a developing sleeve 42 which is exposed outside the developing container 41 and the surface of the photosensitive drum 1 is designed to keep a minute spacing therebetween by a spacer (not shown) as gap regulating means.

The surface of the developing sleeve 42 has desired unevenness in order to heighten the probability of frictional sliding with the toner and to effect the carrying of the toner well, and in the present embodiment, use is made of a sleeve of a diameter 20 mm made of aluminum having its surface subjected to the shaped blast process by glass beads (#600) and having surface roughness of 0.8 $\mu$m as measured by the center line average roughness of JIS B 0601. Also, the photosensitive drum 1 and the developing sleeve 42 are opposed to each other with a gap of 300 $\mu$m therebetween, and the photosensitive drum 1 is rotated at peripheral velocity of 50 mm/s and the developing sleeve 42 is rotated at somewhat higher peripheral velocity of 80 mm/s.

On the developing container 41, an elastic blade 44 as developer layer thickness regulating means is supported above the developing sleeve 42 by a blade supporting metal plate 48, and is provided so that the vicinity of the free end of the elastic blade 44 may abut against the outer peripheral surface of the developing sleeve 42 in a surface-contact fashion. The elastic blade 44 is such that the tip end thereof is located at the upstream side of the developing sleeve 42 with respect to the direction of rotation thereof, that is, abuts in the so-called counter-direction.

The elastic blade 44 may preferably comprise a rubber material such as urethane or silicone rubber or SUS having springy resiliency or a thin metal plate of phosphor bronze as a base body, and a rubber material adhesively secured to the surface thereof bearing against the developing sleeve 42. In the present embodiment, the elastic blade 44 is of a construction in which plate-like urethane rubber having a thickness of 1.0 mm is adhesively secured to a blade supporting metal plate 48, and the abutting pressure thereof with the developing sleeve 42 is 25 g/cm to 35 g/cm. Here, the measurement of the line pressure is that converted from a value obtained by inserting three thin metal plates of a known coefficient of friction into the abutting portion, and pulling out the middle one by a spring balance.

An elastic roller 43 as developer supplying and developer scraping means is supported so as to bear against the developing sleeve 42 and to be rotatable in the same direction (the direction of arrow D) as the developing sleeve 42, at a location upstream of the position at which the elastic blade 44 bears against the developing sleeve 42, with respect to the direction of rotation of the developing sleeve 42.

The elastic roller 43 may preferably be of a foamed skeletal sponge structure or fur brush structure in which fibers of rayon, nylon or the like are implanted on a mandrel, from the viewpoint of the supply of the toner to the developing sleeve 42 and the scraping of the toner, and in the present embodiment, use is made of an elastic roller 43 having an outer diameter of 18 mm comprising a mandrel and polyurethane foam provided thereon.

As the abutting width of the elastic roller 43 with the developing sleeve 42, the range of 1 mm to 8 mm is effective and further, it is desirable to give a relative speed to the developing sleeve 42 at the portion of contact thereof. According to the present embodiment, the abutting width was set to 3 mm, and the elastic roller was rotatively driven at predetermined timing by driving means, not shown, so that the peripheral velocity of the elastic roller 43 might be 50 mm/s during the developing operation, that is, the relative speed of the developing sleeve 42 might be 130 mm/S.

Figure 3:
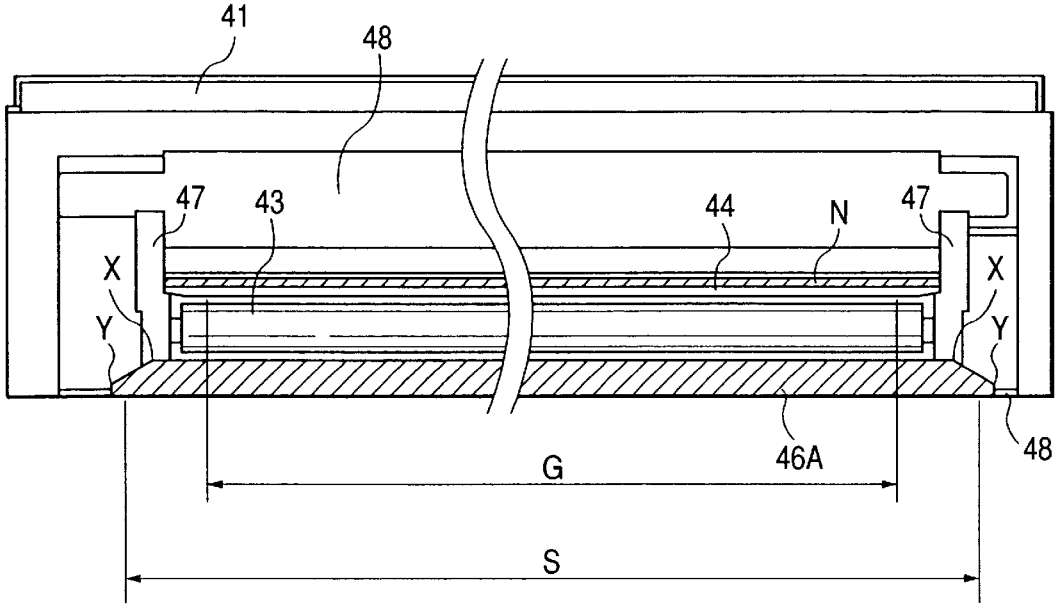
FIG. 3 shows an embodiment of the developing apparatus according to the present invention as it is seen from an image bearing body side except a developer bearing body.

FIG. 3 shows the developing position of the developing apparatus 4 of FIG. 2 as it is seen from the photosensitive drum 1 side, and for the sake of convenience, the developing sleeve 42 is not shown in FIG. 3.

As will be understood from FIG. 3, the distance from the nip N between the elastic blade 44 and the developing sleeve 42 to the tip end (free end) of the elastic blade 44 toward the upstream with respect to the direction of rotation of the developing sleeve 42 becomes continuously shorter toward the lengthwisely opposite end portions of the elastic blade (or the developing sleeve 42), and the lengthwise length of the tip end of the elastic blade is shorter than the lengthwise length of the nip N. That is, the elastic blade 44 is of a shape tapered toward the upstream with respect to the direction of rotation of the developing sleeve 42.

By doing so, the toner layer thickness regulating force of the lengthwisely opposite end areas of the developing sleeve 42 is heightened. That is, it is heretofore known that the thickness of the toner layer formed on the developing sleeve 42 is affected by the distance from a point upstream of the nip N with respect to the direction of rotation of the developing sleeve 42 to the tip end of the elastic-blade 44 and the longer is this distance, the greater is the toner layer thickness and the shorter is this distance, the smaller becomes the toner layer thickness, and in the present embodiment, in the portions wherein the elastic roller 43 does not abut against the developing sleeve 42 (the lengthwisely opposite end portions of the developing sleeve 42), the distance from the nip N with the elastic blade 44 to the tip end of the elastic blade 44 is shortened, whereby the toner layer thickness regulating force of this area is heightened as compared with that of the developing area.

A description will now be made of the toner used in the present embodiment.

The developer used in the present embodiment, as described above, includes only nonmagnetic toner particles (toner) as a nonmagnetic monocomponent developer. Also, as the toner, use is made of one which is spherical and of which the surface is smooth. Such a toner has the advantages that it is excellent in the transfer property and is high in the lubricating property when the so-called untransferred toner remaining on the photosensitive drum 1 without being transferred is removed by cleaning means such as the blade 10 (the present embodiment) or a fur brush and therefore the wear of the surface of the photosensitive drum 1 is small. Specifically, use was made of a toner of which the volume resistance value is $10^{14}$ Ω or greater and $10^{17}$ Ω or less, the shape factor SF-1 is 100 to 180 and the shape factor SF-2 is 100 to 140.

Here, the volume resistance value of the toner was measured by the following measuring method. The area of a measuring electrode plate is 0.283 $cm^2$ (a diameter of 6 mm), the pressure is 980 $g/cm^2$ (96.1 kPa) by the use of a weight of 1500 g, the powder material layer thickness (toner layer thickness) when measured is 0.5 mm to 1.0 mm, a DC voltage of 400 V is applied and the current value is measured by the use of a micrometer (YHP4140 pA METER/DC VOLTAGE SOURCE), and the volume resistance value (nonresistance) is calculated from the obtained resistance value.

Also, the shape factors SF-1 and SF-2 used herein are values obtained by the following method. By the use of FE-SEM (S-800) produced by Hitachi Works Ltd., 100 toner images are sampled at random, and the image information thereof is introduced into an image analyzing apparatus (Luzex 3) produced by Nicolet Japan Corporation through an interface and analyzed, and values calculated from the expressions below are defined as shape factors SF-1 and SF-2.

$$(\text{SF-1})=\{(\text{MXLNG})^2/\text{AREA}\}\times(\pi/4)\times 100$$

$$(\text{SF-2})=\{(\text{PERI})^2/\text{AREA}\}\times(1/4\pi)\times 100$$

Figure 11:
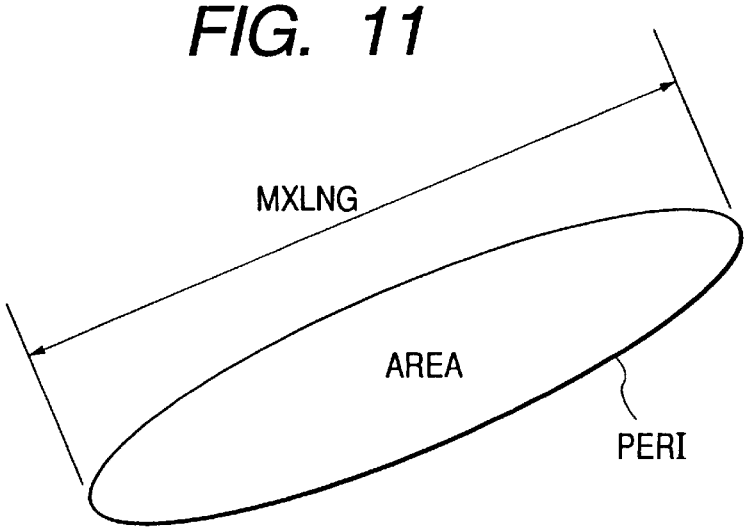
FIG. 11 is a view for illustrating shape factors SF-1 and SF-2.
Figure 12:
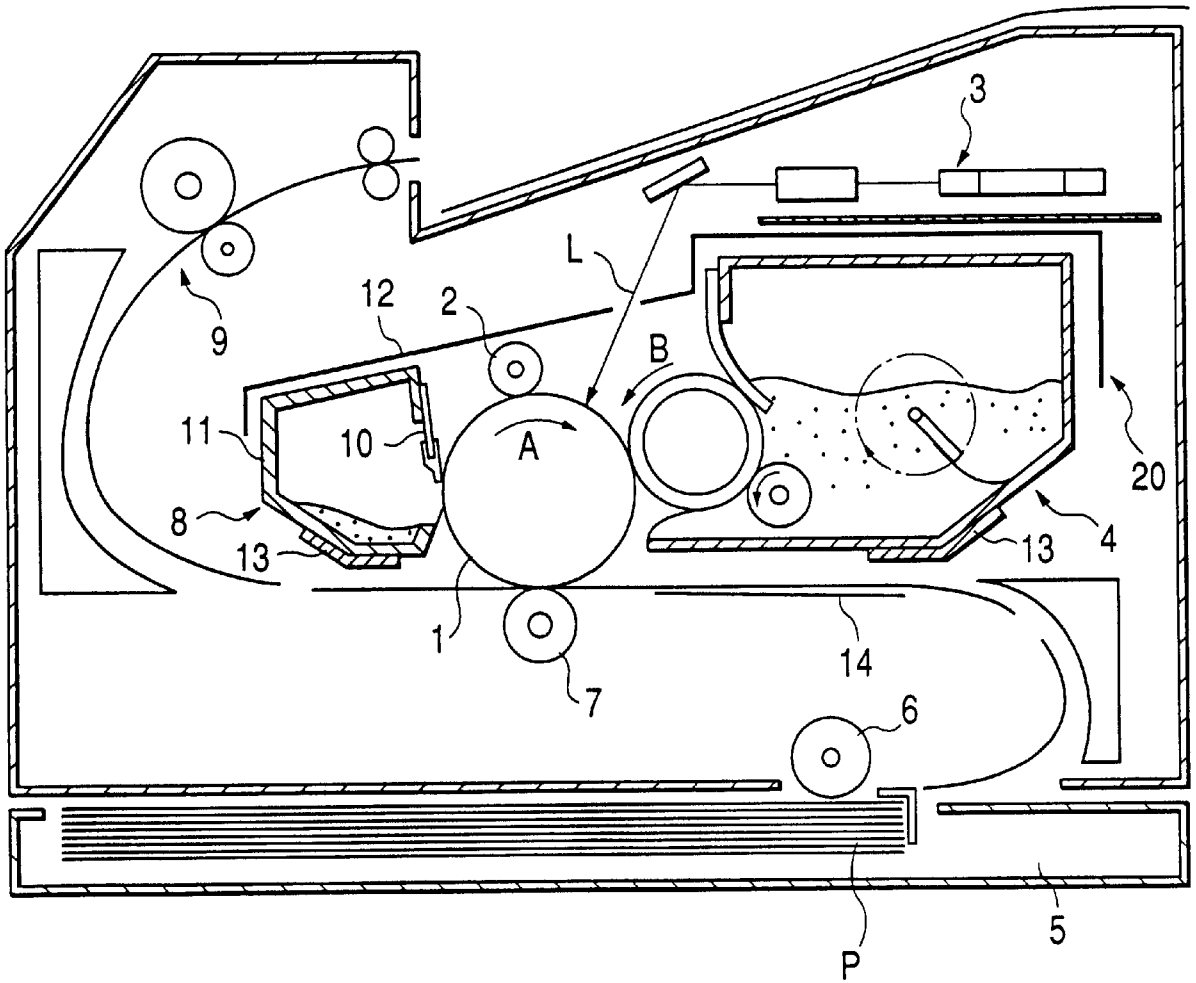
FIG. 12 is a schematic view showing the construction of an embodiment of an image forming apparatus to which a process cartridge according to the present invention is detachably attachable.

As will be understood from FIG. 11, the shape factor SF-1 is a numerical value indicative of the rate of roundness (the degree of sphericity).of the shape of a spherical substance, and the absolute maximum length of an elliptical figure formed with the spherical substance projected onto a two-dimensional plane is MXLNG and the projected area is AREA. Also, the shape factor SF-2 is a numerical value indicative of the degree of unevenness of the spherical substance, and the peripheral length of the projected figure is PERI. The spherical shape gradually becomes an indefinite shape as the shape factor SF-1 becomes greater from 100, and the unevenness of the surface of the toner becomes remarkable as the shape factor SF-2 becomes greater from 100.

Also, as a toner manufacturing method, there is besides a toner (crushed toner) manufacturing method by the so-called crushing method which is heretofore widely known, a toner (polymerized toner) manufacturing method by a so-called polymerizing method such as a method of directly producing a toner by the use of a suspension polymerization method described in Japanese Patent Application Laid-Open No. 36-10231 and Japanese Patent Application Laid-Open No. 59-53856, a dispersion polymerization method of directly producing a toner by the use of a water organic solvent of which the monomer is soluble and the polymer obtained by polymerization is insoluble, or an emulsification polymerization method typified by a soap-free polymerization method of directly polymerizing and producing a toner under the presence of a water-soluble polar polymerization starting agent.

In the present embodiment, however, the shape factors SF-1 and SF-2 can be easily adjusted to 100 to 180 and 100 to 140, respectively, and the particle size distribution is sharp and a fine grain toner having a particle diameter of 4 $\mu$m to 8 $\mu$m (weight average particle diameter) is obtained relatively easily and therefore, the toner was manufactured by the use of the suspension polymerization method under normal pressure or under pressurization. Specifically, by adding styrene and n-butyl acrylate as monomers, a salicylic acid compound as a charge controlling agent, saturated polyester as polar resin and a colorant, colored suspended particles having a weight average particle diameter of 7 $\mu$m were manufactured. Further, by extraneously adding 1.5 wt % of hydrophobic silica, there was manufactured a toner of negative chargeability excellent in transferability as described above and very little abrading the photosensitive drum 1 during cleaning.

When the developing apparatus having the construction as described above starts its developing operation, the toner is agitated by the rotation of the agitating member 45 in the direction of arrow C and is carried to the elastic roller 43 side. Further, the toner is carried to the vicinity of the developing sleeve 42 by the elastic roller 43 being rotated in the direction of arrow D, and the toner borne on the elastic roller 43 in the abutting portion between the developing sleeve 42 and the elastic roller 43 is subjected to frictional charging by frictionally contacting with the developing sleeve 42 and adheres onto the developing sleeve 42.

Thereafter, the toner is sent under the pressure contact of the elastic blade 44 with the rotation of the developing sleeve 42 in the direction of arrow B, and there it receives desired triboelectricity (frictional charging amount) and is formed into a thin layer on the developing sleeve 42. In the present embodiment, the charging charge amount of the toner was set so as to be −60 $\mu$C/g to −20 $\mu$C/g, and the toner coat amount was set so as to be 0.4 mg/cm$^2$ to 1.0 mg/cm$^2$.

Thereafter, the toner layer is carried to the developing position opposed to the photosensitive drum 1. At the developing position, an AC voltage having a DC voltage superposed thereon by a voltage source 49 is applied to between the photosensitive drum 1 and the developing sleeve 42, and by this developing bias voltage, the toner on the developing sleeve 42 flies onto the photosensitive drum 1 and selectively adheres to the electrostatic latent image on the surface of the photosensitive drum 1 to thereby form a toner image.

Any toner remaining on the surface of the developing sleeve 42 without contributing to development is collected from the lower portion of the developing sleeve 42 with the rotation of the developing sleeve 42. The toner on the developing sleeve 42 collected into the developing container 41 is stripped off from the surface of the developing sleeve 42 in the portion of contact between the elastic roller 43 and the developing sleeve 42. Most of the toner stripped off at this time is carried with the rotation of the elastic roller 43 and mixes with the toner contained in the developing container 41 and the charging charges of the toner are dispersed. At the same time, fresh toner is supplied onto the developing sleeve 42 by the rotation of the elastic roller 43, and the operation described above is repeated.

A flexible sheet-like developer sealing member 46 is provided on the above-described toner collecting portion and permits the passage of the toner which has not contributed to development into the developing container 41 and also prevents the toner in the developing container 41 from leaking out from the lower portion of the developing sleeve 42.

Further, in the developing container 41, in order to prevent the leakage of the toner from the lengthwisely opposite end portions of the developing sleeve 42, end portion peripheral surface sealing members 47 are provided on the lengthwisely opposite end portions of the developing sleeve 42 outer than the developing area G at the inner portion opposite to the opening portion of the developing container 41, and prevent the outflow of the toner to the outside of the developing area G. As the end portion peripheral surface sealing members 47, use may preferably be made of ones having the surface thereof comprised of felt or electrostatically implanted hair and having the base material thereof formed by an elastic member, but in the present embodiment, use is made of end portion peripheral surface sealing members 47 of which the surface is a a felt member and the base material is formed elastic member and in which they are fixed by a double-sided adhesive tape.

Reference is now had to FIG. 3 to describe the developer sealing member 46A in greater detail. As described above, for the sake of convenience, the developing sleeve 42 is not shown in FIG. 3. Also, FIG. 3 the lengthwise length S of the developing sleeve 42 and the developing area G are shown.

As the developer sealing member 46A according to the present embodiment, use may preferably be made of a sheet-like sealing member using thin urethane rubber, film-like polycarbonate of weak rigidity, PET or the like as an elastic material, or a sheet-like sealing member of a metal such as SUS or copper, but in the present embodiment, a sheet-like sealing member of SUS is used.

Also, the developer sealing member 46A is lengthwisely longer than the developing area G, and one end of the sealing member 46A at the upstream side with respect to the direction of rotation of the developing sleeve 42 is lengthwisely fixed to the lower frame 48 of the developing container 41. On the other hand, the free end of the developer sealing member 46A contacts with and frictionally slides on the developing sleeve 42 by its own elasticity in such a manner as to be along the direction of rotation of the developing sleeve 42.

According to the present embodiment, the shape of the developer sealing member 46A, as shown in FIG. 3, is made into a trapezoidal shape by cutting away the corners of the lengthwisely opposite end portions of the rectangular shape thereof which are adjacent the free end. That is, the corners X of the lengthwisely opposite end portions of the developer sealing member 46A are designed to be located substantially at the center of the width of the end portion peripheral surface sealing member 47, and the other corners Y of the cut-away sides are designed to be located substantially at the center of the width of the developer sealing member 46A in the direction of rotation of the developing sleeve. Thus, the length of the free end of the sealing member 46A in the lengthwise direction thereof is smaller than the length of the sealing member 46A which is supported by the lower frame 48.

The developer sealing member 46A according to the present embodiment can be sandwiched between the end portion peripheral surface sealing members 47 and the developing sleeve 42 to thereby decrease the area in which the developing sleeve 42 closely contacts with and frictionally slides on the developer sealing member 46A. Further, the length of the sealing member 46A which is supported is great and therefore the sealing member 46A can be firmly supported. Accordingly, the waving of the developer sealing member 46A by the pulling thereof in the direction of frictional sliding can be prevented.

Further, the developer sealing member 46A assuming the above-described shape in accordance with the present embodiment increased the seat surface of the double-sided adhesive tape for fixing this sealing member 46A to the lower frame 48 in the lengthwise direction and strengthous the sticking force to thereby secure the sealing property thereof and therefore, a reduction in the sealing property in the lengthwisely opposite end portions of the lower frame 48 in the lower portion of the opening in the developing container can also be prevented.

Embodiment 2

Figure 4:
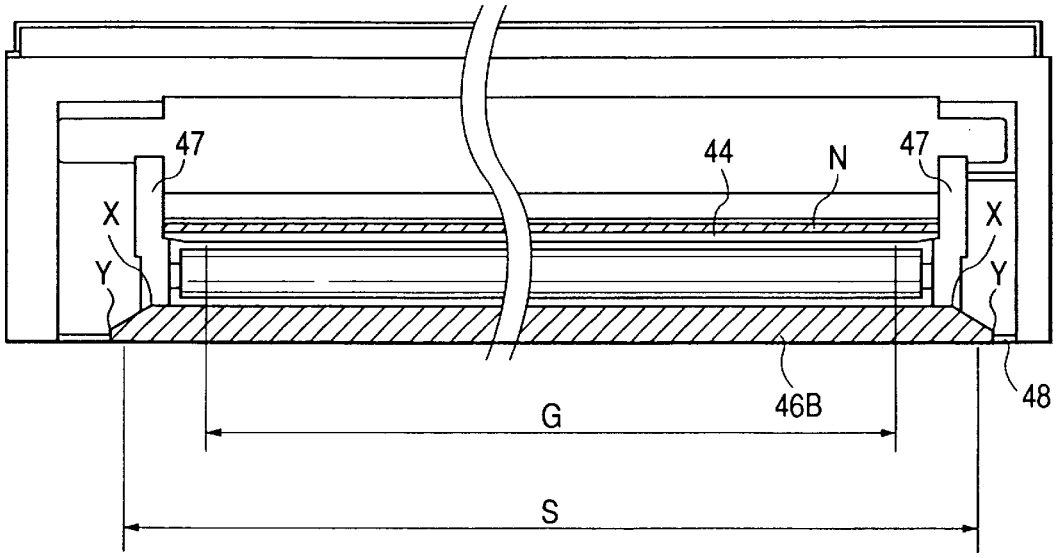
FIG. 4 shows another embodiment of the developing apparatus according to the present invention as it is seen from an image bearing body side except a developer bearing body.

FIG. 4 shows another embodiment of the developer sealing member 46 constructed in accordance with the present invention.

FIG. 4, like FIG. 3, is a view of the developing position of the developing apparatus 4 shown in FIG. 2 as it is seen from the photosensitive drum 1 side, and for the sake of convenience, the developing sleeve 42 is not shown in FIG. 4.

According to the present embodiment, the shape of a developer sealing member 46B, like Embodiment 1, is substantially trapezoidal as viewed from the photosensitive drum 1 side. Further, in the present embodiment, the corner X of the developer sealing member 46 which is adjacent to the free end thereof is chamfered into a curved shape.

Again by using the developer sealing member 46B of the present embodiment, an operational effect similar to that described in Embodiment 1 is obtained.

Embodiment 3

Figure 5:
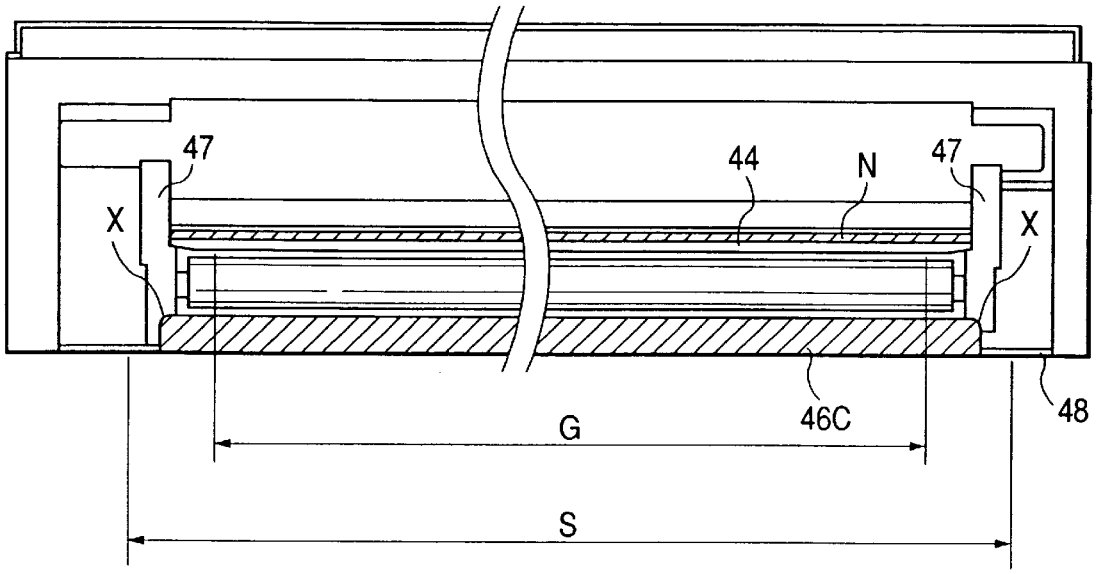
FIG. 5 shows another embodiment of the developing apparatus according to the present invention as it is seen from an image bearing body side except a developer bearing body.

FIG. 5 shows another embodiment of the developer sealing member 46 constructed in accordance with the present invention.

FIG. 5, like FIG. 3, is a view of the developing position of the developing apparatus 4 shown in FIG. 2 as it is seen from the photosensitive drum 1 side, and for the sake of convenience, the developing sleeve 42 is not shown in FIG. 5.

According to the present embodiment, the shape of a developer sealing member 46C is substantially rectangular as viewed from the photosensitive drum 1 side, and the corners X of the lengthwisely opposite end portions of the free end are made into a chamfered curved shape. Also, design is made such that the corner X of the free end side is located substantially at the center of the width of the end portion peripheral surface sealing member 47.

Again by using the developer sealing member 46C of the present embodiment, an operational effect similar to that described in Embodiment 1 can be obtained.

Embodiment 4

Figure 6:
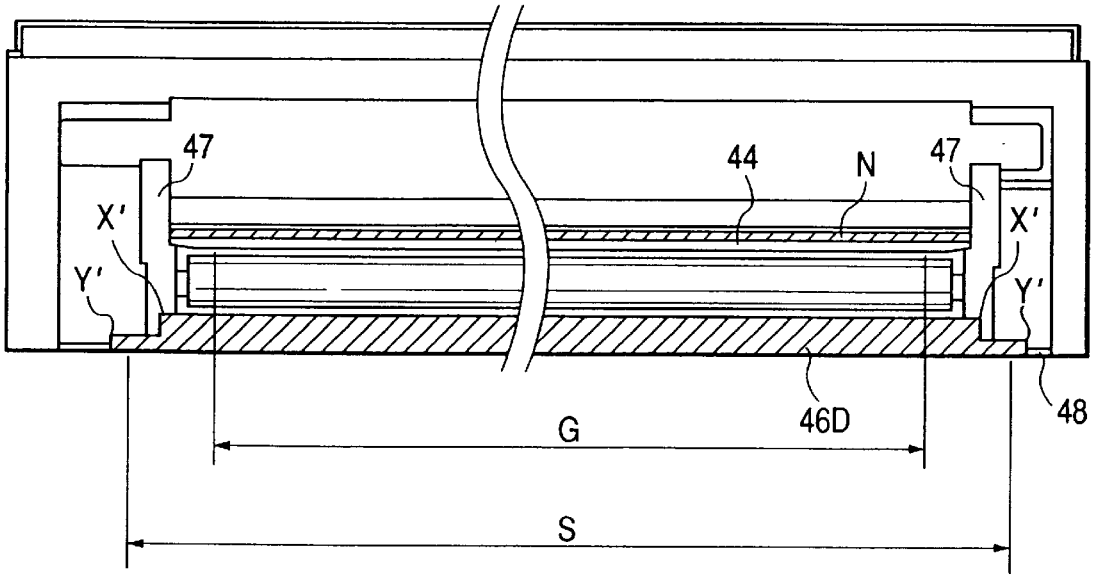
FIG. 6 shows another embodiment of the developing apparatus according to the present invention as it is seen from an image bearing body side except a developer bearing body.

FIG. 6 shows another embodiment of the developer sealing member 46 constructed in accordance with the present invention.

FIG. 6, like FIG. 3, is a view of the developing position of the developing apparatus 4 shown in FIG. 2 as it is seen from the photosensitive drum 1 side, and for the sake of convenience, the developing sleeve 42 is not shown in FIG. 6.

According to the present embodiment, the shape of a developer sealing member 46D is a convex shape as viewed from the photosensitive drum 1 side. That is design is made such that the corners X' of the lengthwisely opposite end portions of the convex portion are located substantially at the center of the width of the end portion peripheral surface sealing members 47 and that the other corners Y' of the free end of the developer sealing member 46D are located substantially at the center of the width of the developer sealing member 46A in the direction of rotation of the developing sleeve 42.

Again by using the developer sealing member 46D of the present embodiment, an operational effect similar to that described in Embodiment 1 can be obtained.

Embodiment 5

Figure 7:
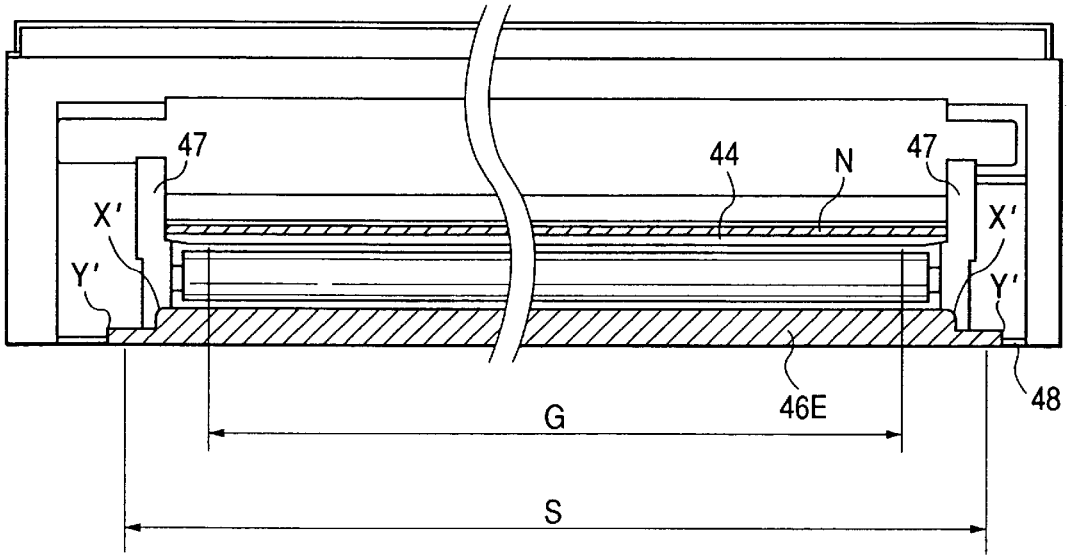
FIG. 7 shows another embodiment of the developing apparatus according to the present invention as it is seen from an image bearing body side except a developer bearing body.

FIG. 7 shows another embodiment of the developer sealing member 46 constructed in accordance with the present invention.

FIG. 7, like FIG. 3, is a view of the developing position of the developing apparatus 4 shown in FIG. 2 as it is seen from the photosensitive drum 1 side, and for the sake of convenience, the developing sleeve 42 is not shown in FIG. 7.

According to the present embodiment, the shape of a developer sealing member 46E, like Embodiment E, is a substantially convex shape as viewed from the photosensitive drum 1 side. In the present embodiment, however, the corners X' of the convex portions are chamfered and exhibit a curved shape.

Again by using the developer sealing member 46E of the present embodiment, an operational effect similar to that described in Embodiment 1 can be obtained.

Embodiment 6

Figure 8:
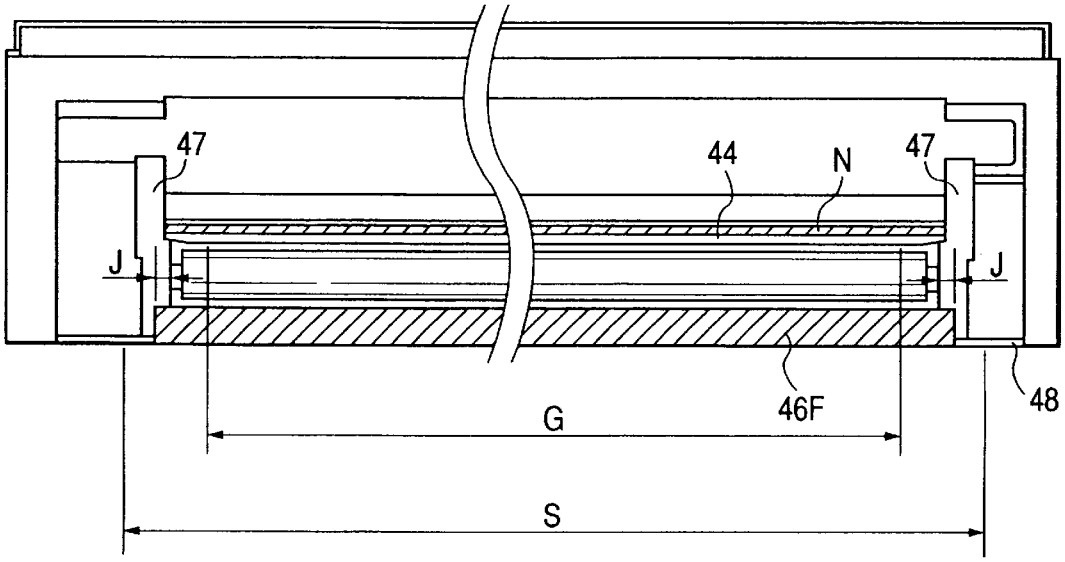
FIG. 8 shows another embodiment of the developing apparatus according to the present invention as it is seen from an image bearing body side except a developer bearing body.
Figure 9:
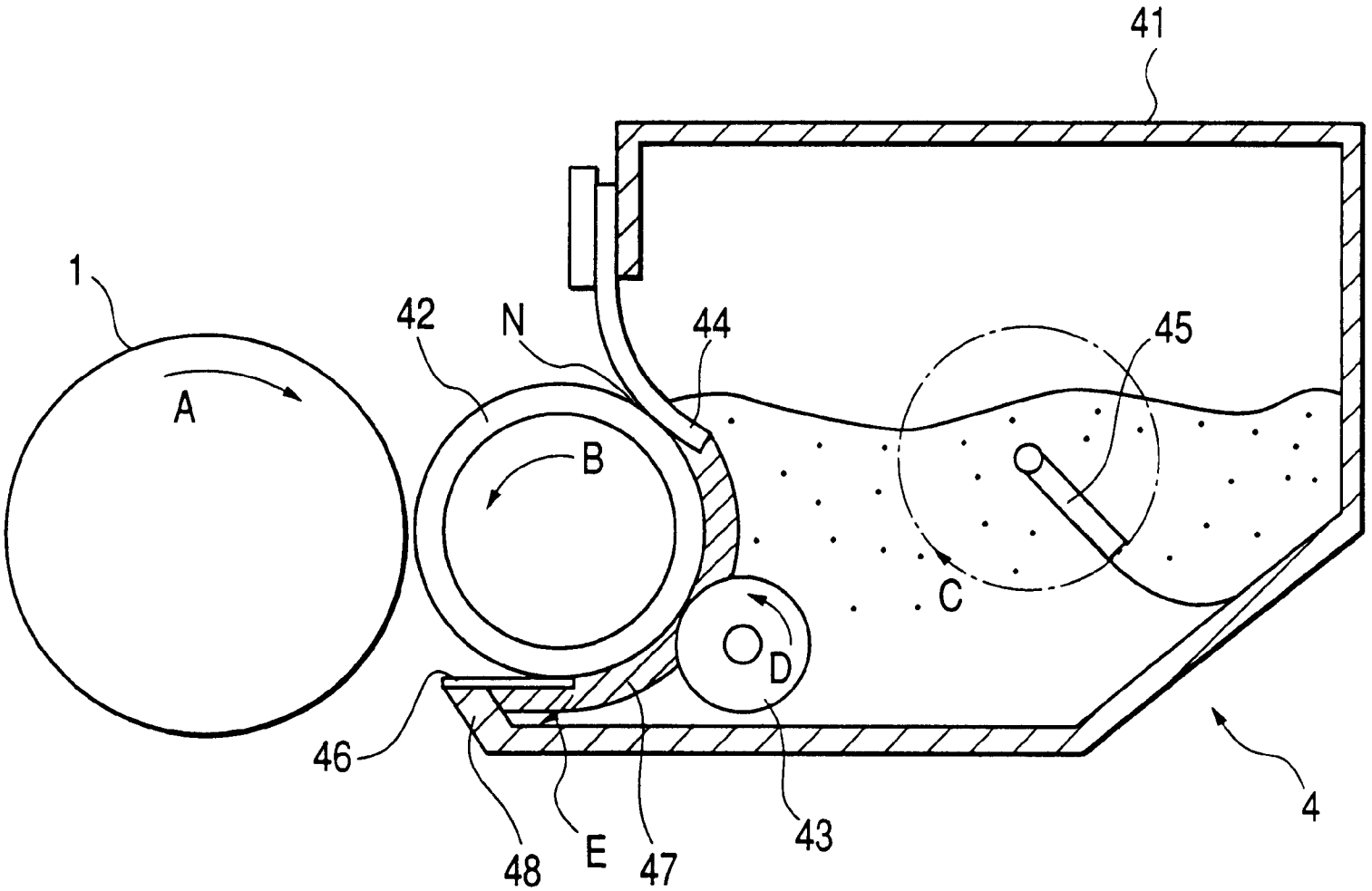
FIG. 9 is a schematic cross-sectional view showing an example of a developing apparatus according to the prior art.
Figure 10:
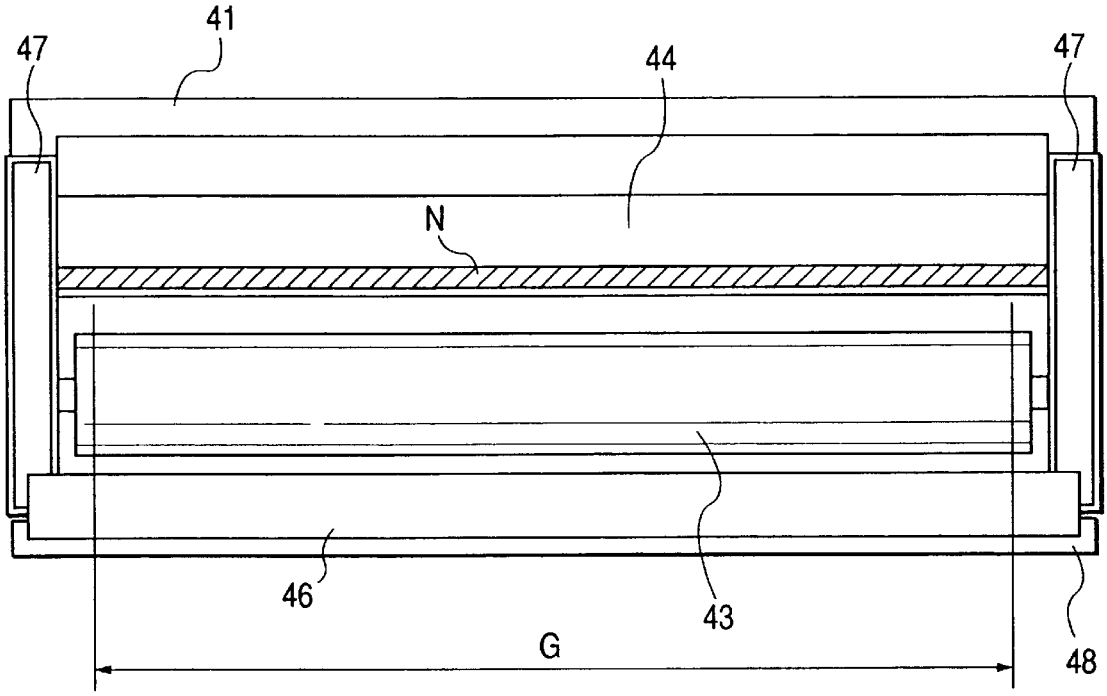
FIG. 10 shows an example of the developing apparatus according to the prior art as it is seen from an image bearing body side except a developer bearing body.

FIG. 8 shows another embodiment of the developer sealing member 46 constructed in accordance with the present invention.

FIG. 8, like FIG. 3, is a view of the developing position of the developing apparatus 4 shown in FIG. 2 as it is seen from the photosensitive drum 1 side, and for the sake of convenience, the developing sleeve 42 is not shown in FIG. 8.

According to the present embodiment, the shape of a developer sealing member 46F is a rectangular shape as viewed from the photosensitive drum 1 side. Further, the amount of overlap J between the lengthwisely opposite end portions of the free end of the developer sealing member F and the end portion peripheral surface sealing members 47 is 7 mm or less. If the amount of overlap J is set to a too small amount, the toner sealing property of the lengthwisely opposite end portions of the developing sleeve 42 is reduced and therefore, the amount of overlap J is 0.5 mm or greater.

Again by using the developer sealing member 46F of the present embodiment, the waving of the sealing member 46F can be prevented and the operational effect of preventing the leakage of the toner can be obtained.

In the above-described embodiments 1 to 6, the developing·apparatus 4 is made into a unit detachably attachable to the main body of the image forming apparatus, whereas the present invention is not restricted thereto, but of course the developing apparatus 4 can be made into a construction fixed to the main body of the image forming apparatus and capable of only replenishing the toner.

Also, it is possible to collectively make the photosensitive drum 1, the charging roller, the developing apparatus 4 and the cleaning device 8 including the cleaning blade 10 and the waste toner container 11 into a unit by the frame member 12, and make the unit into a process cartridge 20 detachably attachable to the main body of the image forming apparatus. In the main body of the image forming apparatus, mounting means 13 for detachably mounting the process cartridge 20 are provided at two locations in the case of the present embodiment.

The process cartridge is not restricted to the above-described construction, but may be at least one of the charging means, the developer bearing body and the cleaning means and the image bearing body integrally made into a cartridge detachably attachable to the main body of the image forming apparatus, and includes, for example, the developer bearing body and the image bearing body integrally made into a cartridge detachably attachable to the main body of the image forming apparatus.

What is claimed is:

1. A developing apparatus comprising:

a developing container containing a developer;

a developer bearing body provided in an opening portion of said developing container for bearing and carrying the developer to a developing position;

a leakage preventing member for contacting with an end portion of said developer bearing body in a lengthwise direction of said developer bearing body and preventing said developer from leaking from said end portion;

a seal member provided in said opening portion for contacting with said developer bearing body with a length greater than a length of a developing area in the lengthwise direction of said developer bearing body;

said seal member being sandwiched between said developer bearing body and said leakage preventing member in said end portion, and in said lengthwise direction, a length of a free end of a seal member being smaller than a length by which said seal member is supported; and a contacting width between said seal member and said leakage preventing member in the lengthwise direction becoming smaller toward said free end.

2. A developing apparatus according to claim 1, wherein a portion in which said seal member is supported is upstream of a portion in which said seal member contacts with said developer bearing body with respect to a direction of rotation of said developer bearing body.

3. A developing apparatus according to claim 1, wherein said seal member contacts with said developer bearing body at said free end.

4. A developing apparatus according to claim 1, wherein said seal member is an elastic body.

5. A developing apparatus according to claim 4, wherein said seal member is sheet-like.

6. A developing apparatus according to claim 1, wherein said leakage preventing member is provided with a base body having elasticity, and a felt or an electrostatically implanted hair provided on said base body.

7. A developing apparatus according to claim 1, wherein said seal member seals a lower portion of said developer bearing body in said opening portion.

8. A developing apparatus according to claim 1, wherein said developer bearing body is rotated at said developing position in the same direction as a direction of rotation of said image bearing body.

9. A developing apparatus according to claim 1, wherein said seal member is of a substantially trapezoidal shape.

10. A developing apparatus according to claim 9, wherein a corner of said free end of the end portion in the lengthwise direction of said seal member is chamfered.

11. A developing apparatus according to claim 1, wherein said seal member is of a substantially rectangular shape, and a corner of said free end of the end portion in the lengthwise direction thereof is chamfered.

12. A developing apparatus according to claim 11, wherein the corner of said free end of the end portion in the lengthwise direction of said seal member is chamfered by a curve.

13. A developing apparatus according to claim 1, wherein said seal member is of a substantially convex shape.

14. A developing apparatus according to claim 13, wherein a corner of said free end of the end portion in the lengthwise direction of said seal member is chamfered.

15. A developing apparatus according to claim 1, wherein said developer is a non-magnetic monocomponent developer.

16. A developing apparatus according to any one of claims 1 to 15, which, together with an image bearing body on which said developing apparatus performs developing operation, constitutes a process cartridge detachably attachable to a main body of an image forming apparatus.

17. A developing apparatus according to claim 1, wherein a tip end portion of said seal member is pinched between said developer bearing body and said leakage preventing member at an end portion of said seal member in the lengthwise direction.

18. A developing apparatus according to claim 1, wherein a portion in which said seal member is supported extends to an outside of said leakage preventing member.

* * * * *

UNITED STATES PATENT AND TRADEMARK OFFICE

CERTIFICATE OF CORRECTION

PATENT NO. : 6,195,515 B1
DATED : February 27, 2001
INVENTOR(S) : Akiyoshi Fujita et al.

It is certified that error appears in the above-identified patent and that said Letters Patent is hereby corrected as shown below:

Column 1,
Line 35, "moncomponent" should read -- monocomponent --; and
Line 46, "non-magnetic" should read -- nonmagnetic --.

Column 2,
Line 18, "non-magnetic" should read -- nonmagnetic --.

Column 3,
Line 19, "the" should read -- be --.

Column 10,
Line 53, "a" (second occurrence) should be deleted; and
Line 54, "is" should read -- is a --; and
Line 56, "had" should read -- made --.

Column 11,
Line 42, "strengthous" should read -- strengthens --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*